US007424246B2

(12) United States Patent
Spence et al.

(10) Patent No.: US 7,424,246 B2
(45) Date of Patent: Sep. 9, 2008

(54) TONER IMAGING MACHINE HAVING AN EXTERNAL FUSING MODULE

(75) Inventors: James J. Spence, Honeoye Falls, NY (US); Michael J. Martin, Hamlin, NY (US); Mark S. Amico, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 244 days.

(21) Appl. No.: 11/295,893

(22) Filed: Dec. 7, 2005

(65) Prior Publication Data

US 2007/0127957 A1 Jun. 7, 2007

(51) Int. Cl.
*G03G 15/00* (2006.01)
*G03G 15/20* (2006.01)

(52) U.S. Cl. ..... 399/110; 399/320; 399/400

(58) Field of Classification Search ..... 399/110, 399/122, 400, 320
See application file for complete search history.

(56) References Cited

U.S. PATENT DOCUMENTS 4,078,929 A 3/1978 Gundlach
6,308,026 B1 * 10/2001 Kouchi ..... 399/110
2006/0257172 A1 * 11/2006 Seo

FOREIGN PATENT DOCUMENTS

JP 11143270 A * 5/1999

OTHER PUBLICATIONS

Nishida, Masayoshi; Image Forming Device, May 1999; Translations done by Schreiber Translation, Inc.*

* cited by examiner

*Primary Examiner*—Susan S Lee
(74) *Attorney, Agent, or Firm*—Tallam I. Nguti

(57) ABSTRACT

A floor standing and environmentally isolated external fusing module dockable with a first external module surround frame surrounding a xerographic toner image marking module is provided and includes (a) a fusing apparatus for receiving from the xerographic toner image marking module a copy sheet carrying an un-fused toner image thereon to heat and permanently fix the toner image onto the copy sheet; (b) a second external module surround frame for surrounding and isolating fusing volatiles from the fusing apparatus to prevent the fusing volatiles from contaminating an imageable surface and wire charging devices in the xerographic toner image marking module, the second external module surround frame having a second set of sheet-path interface and module-to-module docking devices for docking with the xerographic toner image marking module; and (c) floor standing casters mounted to a bottom of the second external module surround frame for movably supporting the floor standing and environmentally isolated external fusing module.

19 Claims, 5 Drawing Sheets

TONER IMAGING MACHINE HAVING AN EXTERNAL FUSING MODULE

The present disclosure relates generally to toner image reproduction machines, and more particularly, concerns a modular such machine having a floor standing environmentally isolated external fusing module for isolating and preventing fusing volatiles from contaminating sensitive image marking module devices.

In a typical toner image reproduction machine, for example an electrostatographic printing process machine contained within a single enclosing frame, an imaging region of a toner image bearing member such as a photoconductive member is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are then heated by a fusing apparatus within the single enclosed frame to permanently affix the powder image to the copy sheet. Image release oils usually are applied to the heated surface of the fusing apparatus to help image release, but unfortunately end up releasing undesirable fusing volatiles into the single enclosed environment. Residual toner particles remaining on the photoconductive surface following image transfer as above are then removed by a cleaning apparatus in order to prepare the surface for forming another toner image.

The foregoing generally describes a typical black and white electrostatographic printing machine. With the advent of multicolor electrophotography, it is desirable to produce multicolor images using any one of a number of different processes such as image-next-to-image or image-on-image single pass or multiple pass processes as highlight color or full color processes.

A typical highlight color reproduction machine records successive electrostatic latent images on the photoconductive surface. One latent image is usually developed with black toner. The other latent image is developed with color highlighting toner, e.g. red toner. These developed toner powder images are transferred to a sheet to form a color-highlighted document. When combined, these developed images form an image corresponding to the entire original document being printed. Such color highlighting reproduction machine can be of the so-called single-pass variety, where the color separations are generated sequentially by separate imaging and toning stations, or of the so-called multiple-pass variety, where the separations are generated by a single imaging station in subsequent passes of the photoreceptor and are alternatively toned by appropriate toning stations. A particular variety of single-pass highlight color reproduction machines using tri-level printing have also been developed. Tri-level electro-statographic printing is described in greater detail in U.S. Pat. No. 4,078,929. As described in this patent, the latent image is developed with toner particles of first and second colors simultaneously. The toner particles of one of the colors are positively charged and the toner particles of the other color are negatively charged.

Another type of color reproduction machine which may produce highlight color copies initially charges the photoconductive member. Thereafter, the charged portion of the photoconductive member is discharged to form an electrostatic latent image thereon. The latent image is subsequently developed with black toner particles. The photoconductive member is then recharged and image wise exposed to record the highlight color portions of the latent image thereon. A highlight latent image is then developed with toner particles of a color other than black, e.g. red, and then developed to form the highlight latent image. Thereafter, both toner powder images are transferred to a sheet and subsequently fused thereto to form a highlight color document One example of a full color process machine having plural image forming stations utilizes an image-on-image (IOI) system in that the photoreceptive member is recharged, re-imaged and developed for each color separation. This charging, imaging, developing and recharging, re-imaging and developing, all followed by transfer to paper, is done in a single revolution of the photoreceptor in so-called single pass machines, while multi-pass architectures form each color separation with a single charge, image and develop, with separate transfer operations for each color. Again as above, the transferred image is fused on the copy sheet using a heated fusing apparatus, while residual toner particles remaining on the photoconductive surface following image transfer as above are then removed by a cleaning apparatus in order to prepare the surface for forming another toner image.

It has been found that in conventional machines as above, the types and sizes of sheets that can be handled by the fusing apparatus are limited by the rest of the machine architecture, and that the fusing volatiles within the single enclosed machine environment end up contaminating sensitive image forming components and detrimentally affecting image quality and the lives of such components.

Thus in accordance with the present disclosure, there has been provided a floor standing and environmentally isolated external fusing module dockable with a first external module surround frame surrounding a xerographic toner image marking module that includes (a) a fusing apparatus for receiving from the xerographic toner image marking module a copy sheet carrying an un-fused toner image thereon to heat and permanently fix the toner image onto the copy sheet; (b) a second external module surround frame for surrounding and isolating fusing volatiles from the fusing apparatus to prevent the fusing volatiles from contaminating an imageable surface and wire charging devices in the xerographic toner image marking module, the second external module surround frame having a second set of sheet-path interface and module-to-module docking devices for docking with the xerographic toner image marking module; and (c) floor standing casters mounted to a bottom of the second external module surround frame for movably supporting the floor standing and environmentally isolated external fusing module.

BRIEF DESCRIPTION OF THE DRAWING

The foregoing and other features of the instant disclosure will be apparent and easily understood from a further reading of the specification, claims and by reference to the accompanying drawing in that:

DETAILED DESCRIPTION

Figure 1:
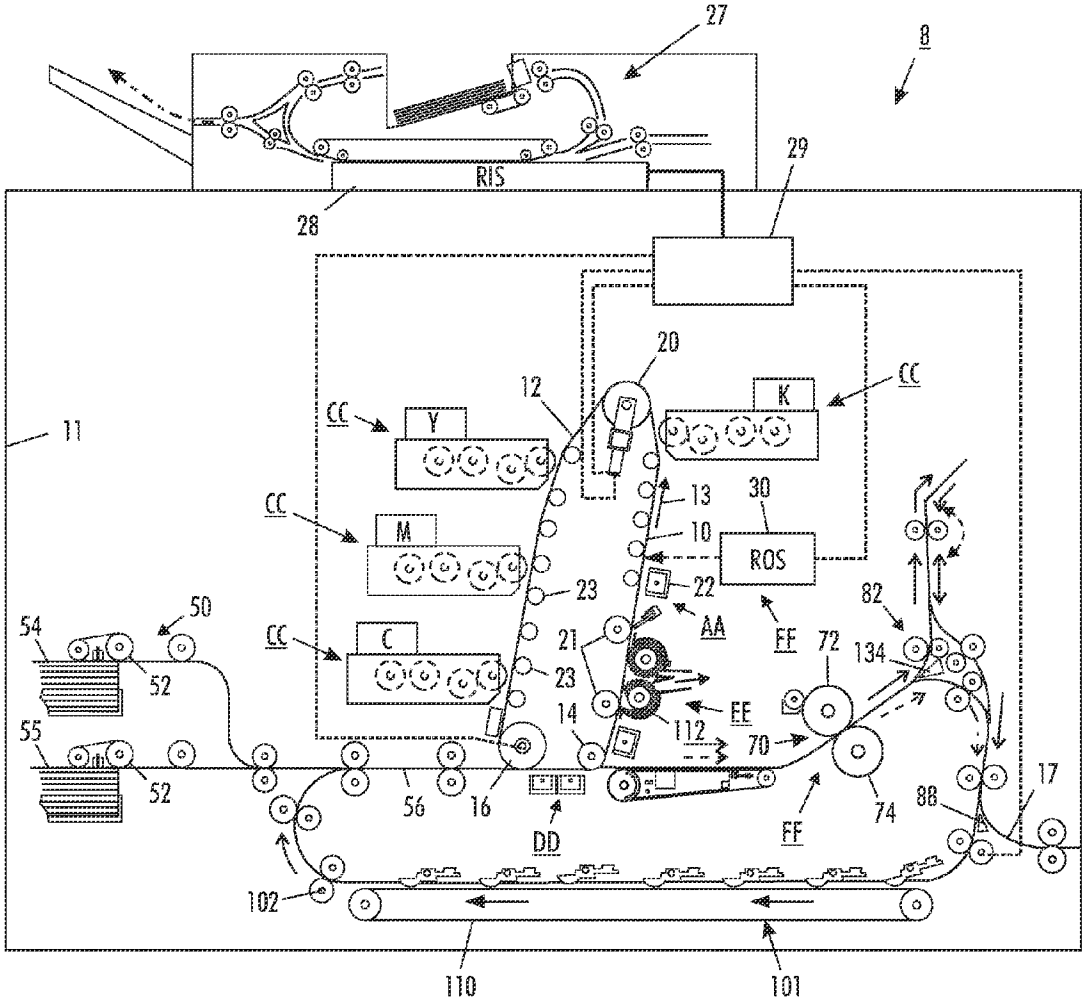
FIG. 1 PRIOR ART
FIG. 1 is a schematic elevational view of a prior art electrostatographic reproduction machine.

Referring first to the FIG. 1, it schematically illustrates a prior art electrostatographic reproduction machine 8 that is comprised of a single machine housing environment defined by an enclosing frame 11. Within the frame 11, the machine 8 includes xerographic image marking stations and devices, and a fusing apparatus producing fusing volatiles for example from the release oil being applied to a heated fuser roller.

As illustrated, the prior art electrostatographic reproduction machine 8 generally employs a photoconductive belt 10 mounted on a belt support module. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop about stripping roll 14, drive roll 16, idler roll 21, and backer rolls 23.

Initially, a portion of the photoconductive belt surface passes through charging station AA. At charging station AA, a charging wire of a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information from and for each machine component.

Still referring to the FIG. 1, at an exposure station BB, the controller or electronic subsystem (ESS), 29, receives the image signals from RIS 28, representing the desired output image, and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top copy sheet 48 and advances it to sheet transport 56. Sheet transport 56 directs the advancing sheet 48 into image transfer station DD to receive a toner image from photoreceptor belt 10 in a timed manner. Transfer station DD typically includes a corona-generating device 58 that sprays ions onto the backside of copy sheet 48. This assists in attracting the toner powder image from photoconductive surface 12 to sheet 48. After transfer, sheet 48 continues to move in the direction of arrow 60 where it is picked up by a pre-fuser transport assembly 101 and forwarded by means of a vacuum transport 110 to a fusing station FF that is within the same single 11 and includes a fuser assembly 70.

The fuser assembly 70 within the frame 11, for example, includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir 73, is pumped to a metering roll as shown for application onto the hot surface of the heated fuser roller 72. As discussed above, ordinarily the release agent applied to the heated surface of the fuser roller results in undesirable fusing volatiles that are released into the air within the machine housed environment within the frame 11. These fusing volatiles have been found to contaminate sensitive imaging components such as the photoreceptor surface and the corona charging wires.

The sheet 48 then passes through fuser assembly 70 where the image is permanently fixed or fused to the sheet. After passing through fuser 70, a gate 88 either allows the sheet to move directly via output 17 to a finisher or stacker, or deflects the sheet into the duplex path 101. Specifically, the sheet (when being directed into the duplex path 101), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 101, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed therefrom by a cleaning apparatus 112 at cleaning station EE.

Figure 2:
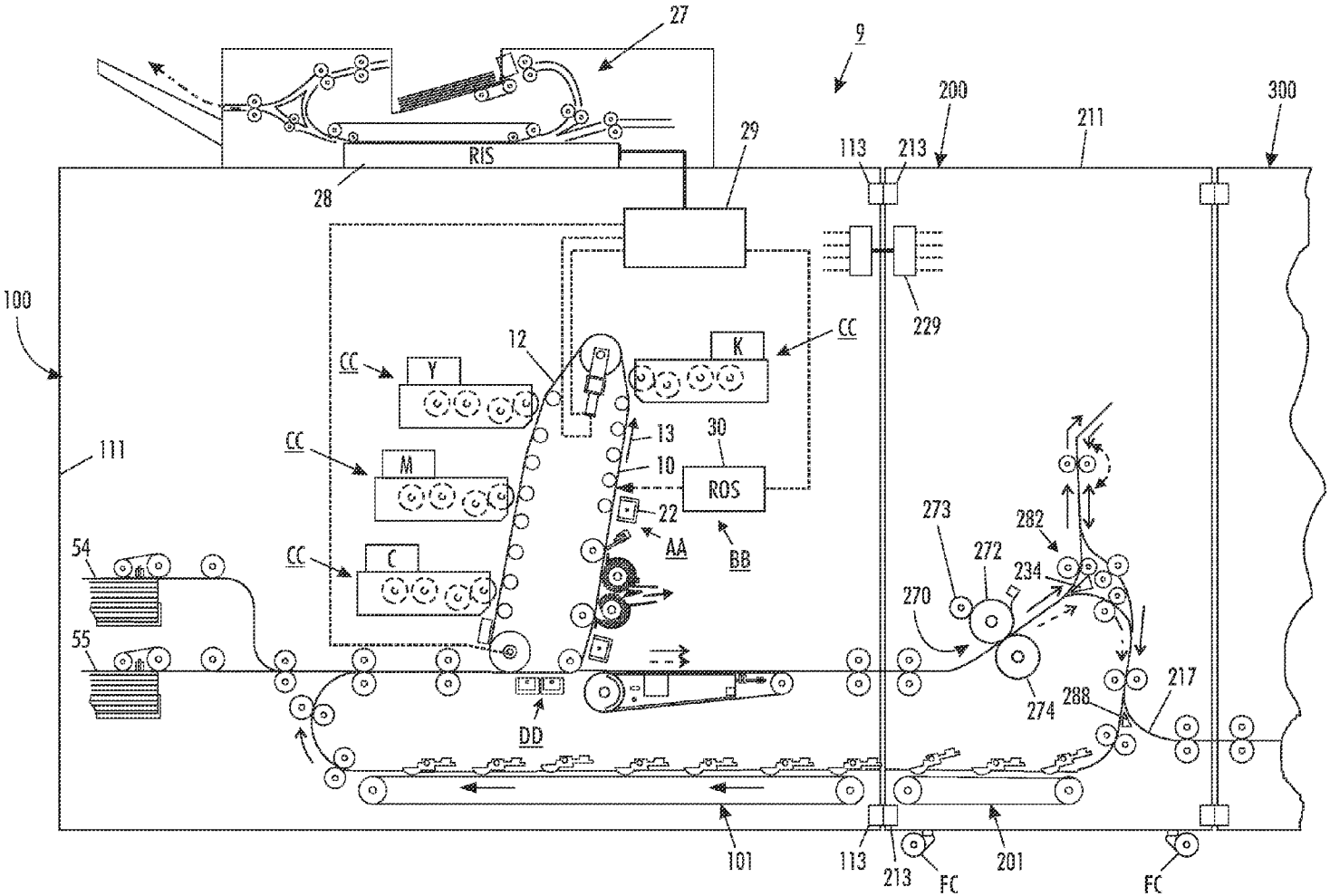
FIG. 2 is a schematic elevational view of a first embodiment of the electrostatographic reproduction machine of the present disclosure including the floor standing environmentally isolated external fusing module having a roller fusing apparatus in accordance with the present disclosure.
Figure 3:
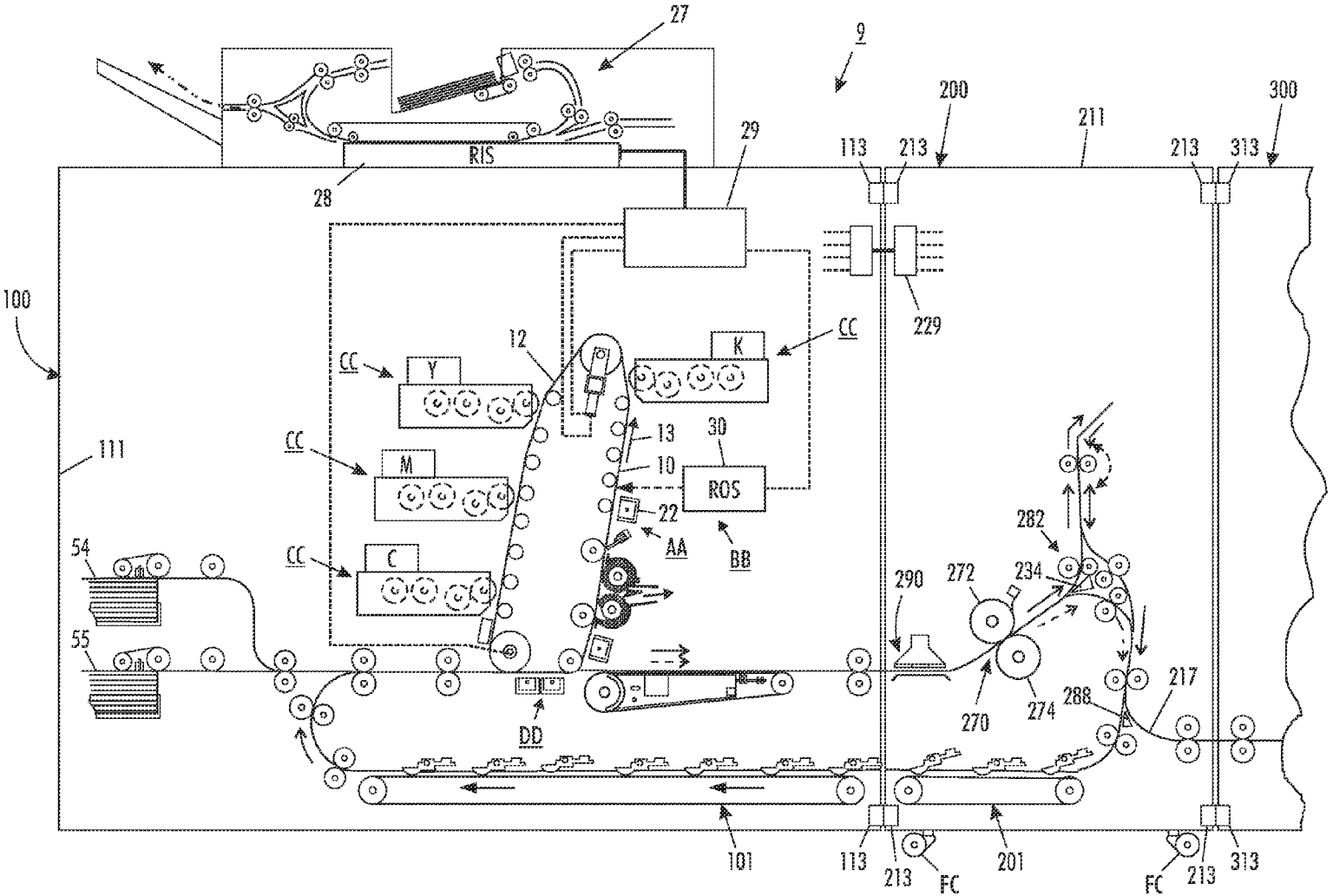
FIG. 3 is a schematic elevational view of a second embodiment of the electrostatographic reproduction machine of the present disclosure showing the floor standing environmentally isolated external fusing module of FIG. 2 including a separate sheet heater in accordance with the present disclosure.
Figure 4:
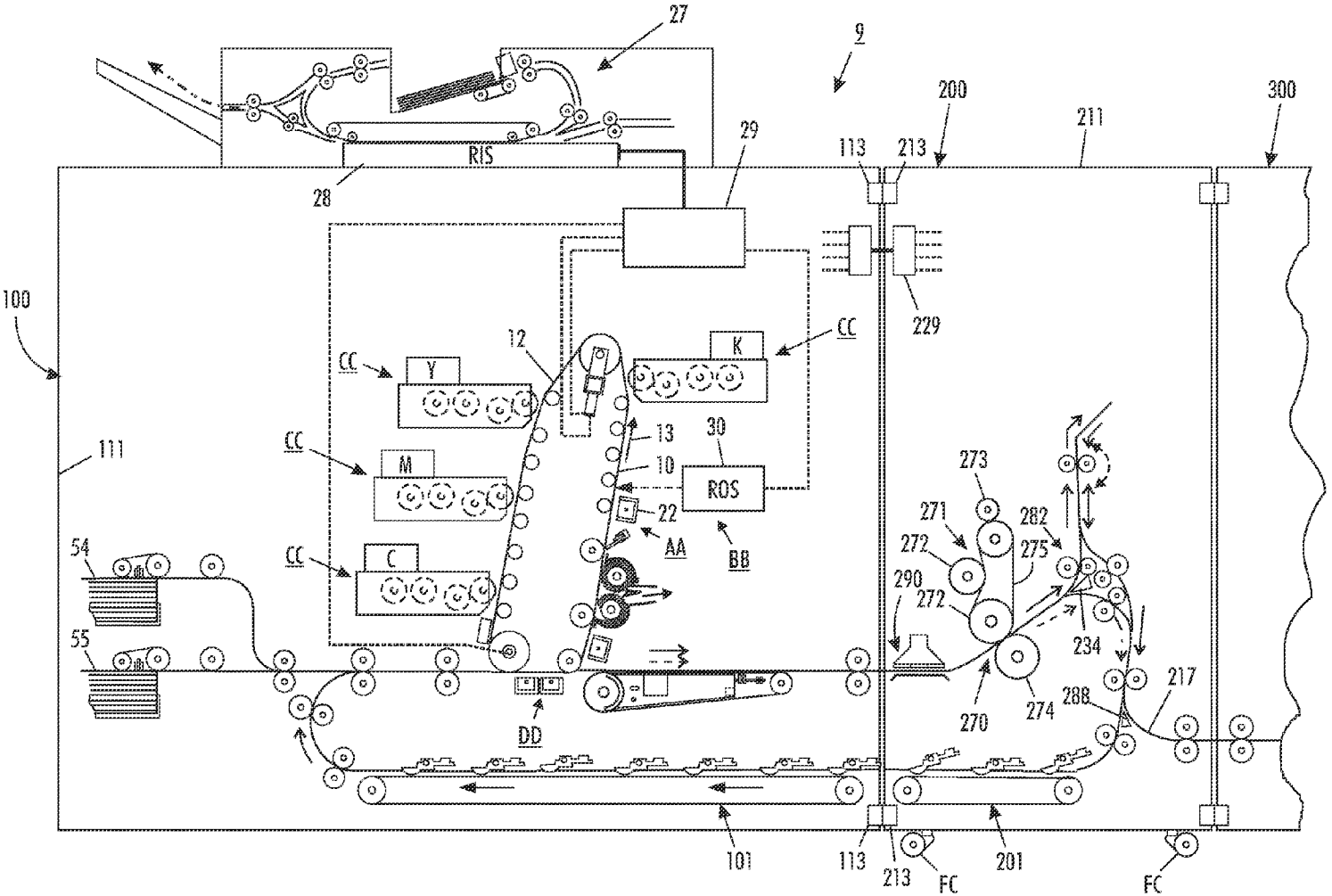
FIG. 4 is a schematic elevational view of a third embodiment of the electrostatographic reproduction machine of the present disclosure having a belt fusing apparatus in accordance with the present disclosure.
Figure 5:
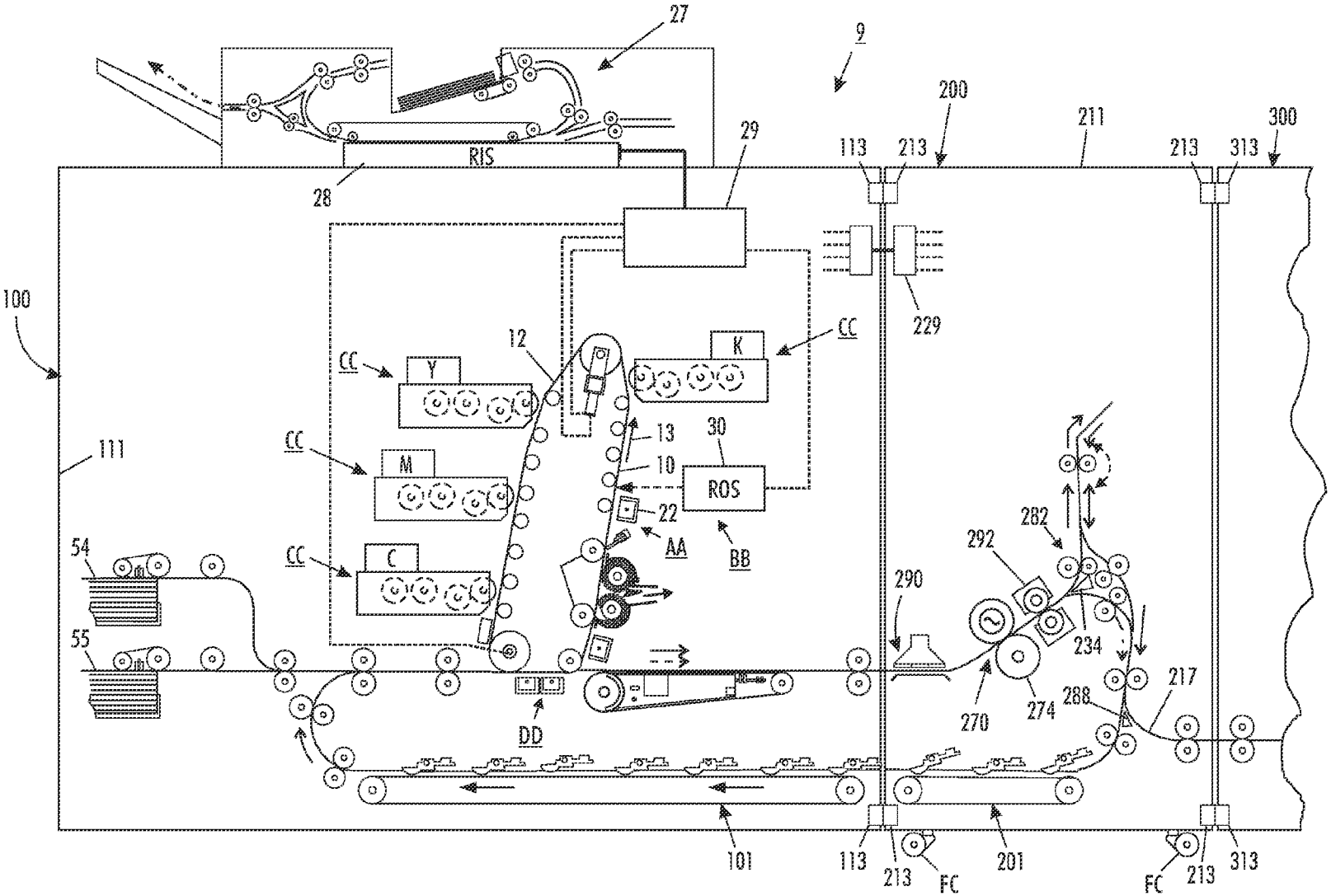
FIG. 5 is a schematic elevational view of a fourth embodiment of the electrostatographic reproduction machine of the present disclosure including the floor standing environmentally isolated external fusing module having a post-fusing sheet conditioning apparatus in accordance with the present disclosure.

Referring now to FIGS. 2-5, various embodiments of the modular electrostatographic image reproduction machine 9 including a xerographic toner image marking first module 100 and a floor standing and environmentally isolated external fusing module 200 of the present disclosure, are illustrated. FIG. 2 illustrates a first embodiment of the electrostatographic reproduction machine of the present disclosure including the floor standing environmentally isolated external fusing module having a roller fusing apparatus 270. FIG. 3 illustrates a second embodiment additionally including a separate sheet heater. FIG. 4 illustrates it with a belt fusing apparatus 271, and FIG. 5 illustrates it a post-fusing sheet conditioning apparatus.

Referring in particular to FIG. 2, the modular electrostatographic image reproduction machine 9 comprises (a) a xerographic toner image marking module 100 for producing an un-fused toner image on a copy sheet that includes (i) copy sheet supply means 54, 55, (ii) a movable photoconductive imaging member 10 having an imageable surface 12 and being movable in the direction 13, (iii) a wire charging device 22 at charging station AA for uniformly charging the imageable surface, (iv) an exposure device 30 at exposure station BB for forming a latent image on the imageable surface 12, (v) toner development devices at development stations CC for developing the latent image, (vi) toner image transfer means at transfer station DD for transferring the toner image from the imageable surface onto a copy sheet, along with a cleaning apparatus at cleaning station EE, and (vii) a first external module surround frame 111 surrounding all the components of the toner image marking module 100. As further shown, the toner image marking module has a first set of sheet-path interface 101, and module-to-module docking devices 113.

As in the prior art, initially, a portion the surface 12 of the imaging member or photoconductive belt 10 passes through charging station AA. At charging station AA, a charging wire of a corona-generating device 22 charges the photoconductive belt 10 to a relatively high, substantially uniform potential. At the exposure station BB, a controller or electronic subsystem (ESS), 29, receives image signals of a document on a document feeder 27 from a RIS 28, representing the desired output image, and processes these signals to convert them to a continuous tone or gray scale rendition of the image. Signals from the RIS are then transmitted to a modulated output generator, for example the raster output scanner (ROS), 30. The image signals transmitted to ESS 29 may originate from RIS 28 as described above or from a computer, thereby enabling the electrostatographic reproduction machine 9 to serve as a remotely located printer for one or more computers.

In accordance with the present disclosure, the modular electrostatographic image reproduction machine 9 also includes (b) the environmentally isolated external fusing module 200 that is docked with the xerographic toner image marking module 100. As illustrated, in a first embodiment, the environmentally isolated external fusing module 200 includes (i) a roller fusing apparatus 270, comprising a fuser roller 272 and pressure roller 274, for receiving the copy sheet with the un-fused toner image thereon and heating and permanently fixing the toner image onto the copy sheet, and (ii) a second external module surround frame 211 for fully enclosing and isolating fusing volatiles from the fusing release agent 273, thus preventing them from contaminating the imageable surface 12 and the wire charging device 22 for example. The second external module surround frame 211 has a second set of sheet-path interface 201, and module-to-module docking devices 213 for inter-docking with the first external module surround frame 111. As further shown, the environmentally isolated external fusing module 200 includes a control connector 229 coupled to the controller 29 for also controlling operations of components of said environmentally isolated external fusing module.

After passing through the fusing apparatus 270, a gate 288 either allows the sheet to move directly via output 217 to a finisher or stacker module 300, or deflects the sheet into the duplex path 201. Specifically, the sheet (when being directed into the duplex path 201), is first passed through a gate 234 into a single sheet inverter 282. That is, if the second sheet is either a simplex sheet, or a completed duplexed sheet having both side one and side two images formed thereon, the sheet will be conveyed via gate 288 directly to output 217. However, if the sheet is being duplexed and is then only printed with a side one image, the gate 288 will be positioned to deflect that sheet into the inverter 282 and into the duplex loop path 201, where that sheet will be inverted and then fed for recirculation back through the toner image forming module 100 for receiving an unfused toner image on side two thereof.

Referring now to FIGS. 3-5, the modular electrostatographic image reproduction machine 9 includes second, third and fourth different embodiments of the floor standing and environmentally isolated external fusing module 200 that is each dockable with the first external module surround frame 111 of the xerographic toner image marking module 100. In the second embodiment as shown in FIG. 3, the floor standing and environmentally isolated external fusing module 200 includes the roller type fusing apparatus 270 and a stand alone heating device 290 within the second external module surround frame 211. The stand alone heating device 290 as such is separate from the fusing apparatus 270 and is used for also applying heat to the copy sheet and to the unfused toner image. The stand alone heating device 290 is mounted along a path of sheet movement within the floor standing and environmentally isolated external fusing module and upstream of the fusing apparatus 270 relative to sheet movement.

As illustrated in FIG. 4, the third embodiment of the floor standing and environmentally isolated external fusing module 200 includes a belt type fusing apparatus 271 and the stand alone heating device 290 within the second external module surround frame 111. The belt fusing apparatus includes a pressure roller 274, a movable flexible fusing belt 275 forming a fusing nip against the pressure roller, and a heating device 272 for heating the movable flexible fusing belt. Fusing release agent 273 can be applied to the surface of fusing belt 275.

As illustrated in FIG. 5, the fourth embodiment of the floor standing and environmentally isolated external fusing module 200 additionally includes a copy sheet conditioning device 292 that is mounted downstream of the fusing apparatus 270 relative to a direction of sheet movement.

In each of the embodiments, the floor standing and environmentally isolated external fusing module includes a belt vacuum transport device 201 forming part of a sheet path therein, sheet-path interface devices, module-to-module docking devices 213, a sheet inverter, and duplex path apparatus as described above. Each of the embodiments further includes the control connector 229 connected to the machine controller 29 for controlling operations of components of the machine as a whole including those of the environmentally isolated external fusing module.

Although the xerographic toner image marking module 100 is illustrated as an image-on-image full color process type module, it should be understood that any of the electrostatographic processes (black and white, highlight color and full process color as described in the background) can equally be used for making the marks or creating the unfused toner images on a sheet or substrate for forwarding to the floor standing and environmentally isolated external fusing module of the present disclosure.

As can be seen, there has been provided a floor standing and environmentally isolated external fusing module dockable with a first external module surround frame surrounding a xerographic toner image marking module that includes (a) a fusing apparatus for receiving from the xerographic toner image marking module a copy sheet carrying an un-fused toner image thereon to heat and permanently fix the toner image onto the copy sheet; (b) a second external module surround frame for surrounding and isolating fusing volatiles from the fusing apparatus to prevent the fusing volatiles from contaminating an imageable surface and wire charging devices in the xerographic toner image marking module, the second external module surround frame having a second set of sheet-path interface and module-to-module docking devices for docking with the xerographic toner image marking module; and (c ) floor standing casters FC mounted to a bottom of the second external module surround frame for movably supporting the floor standing and environmentally isolated external fusing module.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A floor standing and environmentally isolated external fusing module dockable with a first external module surround frame surrounding a xerographic toner image marking module and having a first set of sheet-path interface and module-to-module docking devices, said floor standing and environmentally isolated external fusing module comprising:

(a) a fusing apparatus for receiving from said xerographic toner image marking module a copy sheet carrying an un-fused toner image thereon to heat and permanently fix said toner image onto said copy sheet;

(b) a second external module surround frame for surrounding and isolating fusing volatiles from said fusing apparatus to prevent said fusing volatiles from contaminating an imageable surface and wire charging devices in said xerographic toner image marking module, said second external module surround frame having a second set of sheet-path interface and module-to-module docking devices for inter-docking with said xerographic toner image marking module;

(c) floor standing casters mounted to a bottom of said second external module surround frame for movable supporting said floor standing and environmentally isolated external fusing module.

2. The floor standing and environmentally isolated external fusing module of claim 1 including a stand alone heating device within said second external module surround frame, separate from said fusing apparatus, for also applying heat to said copy sheet and to said unfused toner image.

3. The floor standing and environmentally isolated external fusing module of claim 1 including a belt vacuum transport device forming part of a sheet path therein.

4. The floor standing and environmentally isolated external fusing module of claim 1 including sheet inverter and duplex path apparatus.

5. The floor standing and environmentally isolated external fusing module of claim 1, including a control connector coupled to a controller for controlling operations of components of said environmentally isolated external fusing module.

6. The floor standing and environmentally isolated external fusing module of claim 1, including a copy sheet conditioning device mounted downstream of said fusing apparatus relative to a direction of sheet movement.

7. The floor standing and environmentally isolated external fusing module of claim 1, wherein said second external module surround frame defines a machine enclosed environment around said fusing apparatus.

8. The floor standing and environmentally isolated external fusing module of claim 1, wherein said fusing apparatus includes a pressure roller and a heated fuser roller forming a fusing nip with said pressure roller.

9. The floor standing and environmentally isolated external fusing module of claim 1, wherein said fusing apparatus includes a pressure roller, a movable flexible fusing belt forming a fusing nip against said pressure roller, and a heating device for heating said movable flexible fusing belt.

10. The floor standing and environmentally isolated external fusing module of claim 2, wherein said stand alone heating device is mounted along a path of sheet movement within said floor standing and environmentally isolated external fusing module and upstream of said fusing apparatus relative to sheet movement.

11. A modular electrostatographic image reproduction machine comprising:

(a) a xerographic toner image marking module for producing an un-fused toner image on a copy sheet, the xerographic toner image marking module including (i) copy sheet supply means, (ii) a movable photoconductive imaging member having an imageable surface, (iii) a wire charging device for uniformly charging said imageable surface, (iv) an exposure device for forming a latent image on said imageable surface, (v) a toner development device for developing said latent image, (vi) toner image transfer means for transferring the toner image from the imageable surface onto a copy sheet, and (vii) a first external module surround frame having a first set of sheet-path interface and module-to-module docking devices; and (b) a environmentally isolated external fusing module docked with said xerographic toner image marking module, said environmentally isolated external fusing module including (i) a fusing apparatus for receiving said copy sheet with said un-fused toner image thereon and heating and permanently fixing said toner image onto said copy sheet, (ii) a second external module surround frame for isolating fusing volatiles and preventing them from contaminating said imageable surface and said wire charging device, said second external module surround frame having a second set of sheet-path interface and module-to-module docking devices for interdocking with said first external module surround frame, and (iii) a sheet inverter and duplex.

12. The modular electrostatographic image reproduction machine of claim 11, wherein said environmentally isolated external fusing module includes a stand alone heating device separate from said fusing apparatus for also applying heat to said copy sheet and said unfused toner image.

13. The modular electrostatographic image reproduction machine of claim 11, wherein said xerographic toner image marking module includes a first belt vacuum transport device forming part of a sheet movement path therein.

14. The modular electrostatographic image reproduction machine of claim 11, wherein said environmentally isolated external fusing module includes a belt vacuum transport device forming part of a sheet movement path therein.

15. The modular electrostatographic image reproduction machine of claim 11, including a controller for controlling operations of components of said xerographic image marking module and of said environmentally isolated external fusing module.

16. The modular electrostatographic image reproduction machine of claim 11, including a finishing module docked downstream of said fusing module for receiving and finishing copy sheets carrying fused and permanently fixed toner images.

17. The modular electrostatographic image reproduction machine of claim 11, wherein said first external module surround frame defines a first machine enclosed environment around xerographic image marking devices of the electrostatographic image reproduction machine.

18. The modular electrostatographic image reproduction machine of claim 11, wherein said second external module surround frame defines a machine enclosed environment, separated from a first machine enclosed environment, around said fusing apparatus of the electrostatographic image reproduction machine.

19. The modular electrostatographic image reproduction machine of claim 12, wherein said stand alone heating device is mounted along a path of movement of said copy sheet and upstream of said fusing apparatus relative to said movement of said copy sheet.

* * * * *